United States Patent [19]

Powell

[11] 4,128,254

[45] Dec. 5, 1978

[54] SKATEBOARD WHEELS

[76] Inventor: George A. Powell, 725 Union Ave., Santa Barbara, Calif. 93103

[21] Appl. No.: 754,945

[22] Filed: Dec. 28, 1976

[51] Int. Cl.[2] ..... A63C 17/22

[52] U.S. Cl. ..... 280/87.04 A; 301/5.7; 301/63 PW

[58] Field of Search ..... 280/87.04 A, 87.04 R, 280/11.27, 11.28, 11.19, 11.1 BR, 11.1 BT; 301/5.3, 5.7

[56] References Cited

U.S. PATENT DOCUMENTS

| | | | |
|---|---|---|---|
| 2,064,690 | 12/1936 | Schavone | 280/11.28 |
| 2,166,767 | 7/1939 | Petermann | 280/11.22 |
| 2,878,071 | 3/1959 | Fowlkes | 301/5.3 |
| 3,414,280 | 12/1968 | Ohashi | 280/11.19 |
| 3,565,454 | 2/1971 | Stevenson | 280/87.04 A |
| 3,945,655 | 3/1976 | Banks | 280/87.04 A |

FOREIGN PATENT DOCUMENTS

| | | | |
|---|---|---|---|
| 800880 | 7/1936 | France | 280/11.1 BT |
| 1002311 | 8/1965 | United Kingdom | 301/5.3 |

*Primary Examiner*—John A. Pekar
*Attorney, Agent, or Firm*—Lyon & Lyon

[57] ABSTRACT

A skateboard comprises an elongated platform and at least one pair of wheels secured to and positioned beneath the platform. The wheels are axially spaced apart from each other along a common axis transverse to the longitudinal center line of the platform. Each wheel defines a circular cylindrical tread surface where the axially inner edge and the axially outer edge of the cylindrical tread surface have a radius of from about $\frac{1}{8}$ to about $\frac{1}{2}$ inch.

16 Claims, 2 Drawing Figures

SKATEBOARD WHEELS

BACKGROUND OF THE INVENTION

Figure 1:
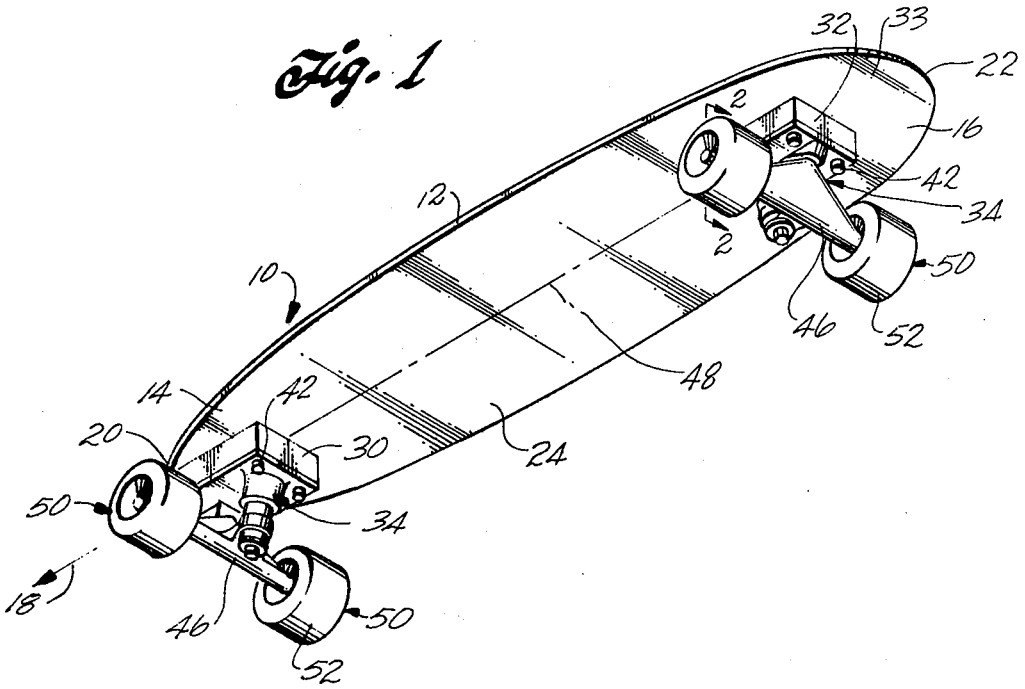

The present invention relates to skateboards, and more specifically to the wheels used for skateboards.

Conventional skateboards have an elongated plank or platform sized for supporting a person in a standing position and a pair of set of fore and aft wheels secured beneath the board. Such a skateboard is described in U.S. Pat. No. 3,565,454 issued to Richard Lawrence Stevenson.

Wheels for skateboards can define a cylindrical tread section having sharp or broken edges such as the wheel shown in the above-mentioned U.S. Pat. No. 3,565,454. A problem with such wheels is that when the board tilts when it is used for acrobatic maneuvers and turns, there is a tendency for a portion of the wheels to tilt away from the ground with resultant sliding of the skateboard. Another problem is that because of the sharp edge of the cylindrical thread portion, reduced tread surface is available when the skateboard tilts when cornering or turning, thus making the board difficult to control. In addition, instability when going over bumps, twigs and the like is incurred with such wheels.

Attempts have been made to overcome the disadvantages of wheels having sharp edged cylindrical tread sections by providing deformable lips or extensions on one or both edges of the tread section. Wheels with such lips have increased traction and resistance to sideways slip but result in considerable loss of speed during sharp turns due to greatly increased rolling friction as a result of lip deformation. Also such a lip can deform and fold under the main portion of the wheel when the lip contacts the edge of a raised portion of the surface being traveled over such as a crack or other irregularity in the riding surface, especially when the direction of travel is not perpendicular to such obstacles or surface irregularities. Both of these conditions can result in sudden loss of speed and can lead to a rider being thrown from the skateboard with resultant injuries.

Thus there is a need for skateboards having wheels which provide sufficient tread area for adequate traction when cornering or turning, and which easily travel over bumps, rocks, twigs, raised areas, and the like, without sudden loss of speed.

SUMMARY OF THE INVENTION

According to the present invention there is provided a skateboard having wheels exhibiting the above features. The skateboard comprises an elongated platform and at least one pair of wheels secured to and positioned beneath the platform. The wheels ar axially spaced apart from each other along a common axis transverse to the longitudinal center line of the platform. Each wheel defines a circular cylindrical tread surface, where the axially inner edge and the axially outer edge of the cylindrical tread surface of each such wheel have a radius of from about $\frac{1}{8}$ to about $\frac{1}{2}$ inch. It is the presence of this radius at both the inner and outer edge of the cylindrical tread surface which allows the skateboard to be quickly, safely and easily utilized in sharp, fast turns and over uneven surfaces without sudden loss of speed.

Preferably all of the wheels attached to the skateboard are similar in shape and have the following dimensions: a diameter of from about $1\frac{3}{4}$ to about $2\frac{3}{4}$ inches, a width for the tread surface of from about $1\frac{1}{2}$ to about $2\frac{3}{4}$ inches; a radius for the axially outer edge of the cylindrical tread surface of from about $\frac{1}{4}$ to about $\frac{1}{2}$ inch and most preferably about $\frac{3}{8}$ inch; and a radius for the axially inner edge of the cylindrical tread surface of from about $\frac{1}{8}$ to about $\frac{3}{8}$ inch and most preferably about $\frac{1}{4}$ inch. Preferably the radius of the axially outer edge of the cylindrical tread surface of each wheel is greater than the radius of the axially inner edge of the cylindrical tread surface.

Because of the radiused edges of the cylindrical tread section of the wheels, a skateboard having wheels according to this invention has good traction with the ground, fast speed, high stability, very quick response for ease of turning, and an uncanny ability to roll over obstacles such as cracks, bumps, twigs and the like without sudden loss of speed and stability.

DRAWINGS

Figure 2:
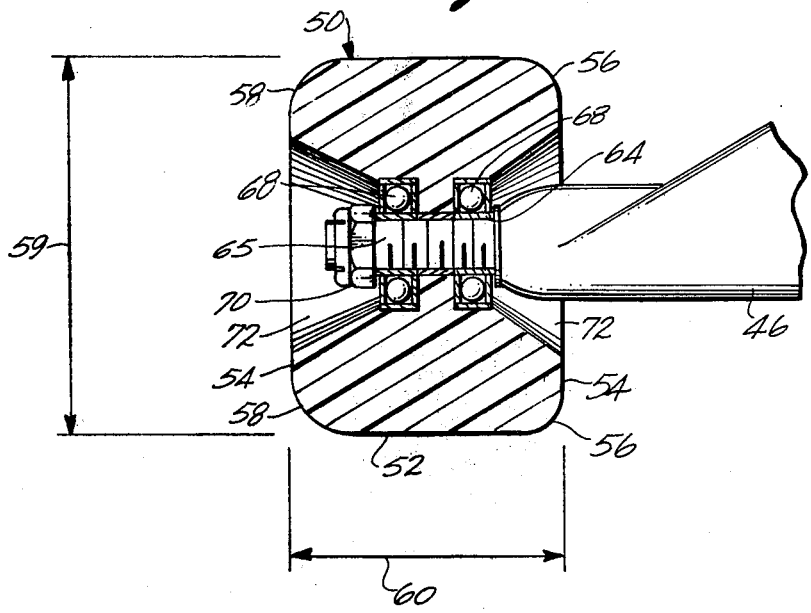

These and other features, aspects and advantages of the present invention will become better understood with reference to the following description, appended claims, and accompanying drawings where:

FIG. 1 is a perspective view of a skateboard having wheels according to this invention; and FIG. 2 is a cross-sectional view of a wheel along line 2—2 in FIG. 1.

DESCRIPTION

With reference to FIG. 1, a skateboard 10 is constructed with a flat elongated board or platform 12 characterized by a forward end section 14 and a rearward end section 16. A person traveling on this skateboard 10 under normal circumstances will move in the general direction indicated by arrow 18. The width of the platform 12 decreases toward both the forward end section 14 and the rearward end section 16. The forward or leading edge 20 of the platform is rounded and the rearward or trailing edge 22 is blunt shaped with rounded corners. The plateform can be constructed from a stiff and resilient material such as fiberglass, or preferably of a laminate construction comprising two outer sheets of a metal such as aluminum and an inner wood sheet such as a slab of hardwood. The inner wood sheet can also be a laminate of a plurality of wood sheets. The outer aluminum sheets and the inner wood sheet can be bonded together by a suitable adhesive such as an epoxy. The upper surface 8 of the platform 12 can be treated to provide a slip resistant surface such as by bonding fine sand particles (not shown) to the surface.

On the underside 24 of the platform 12 is a forward spacer block 30 and a rearward spacer block 32. The spacer blocks are of wood, rubber, metal or other elastomeric or rigid material. The rearward spacer block 32 can be positioned inwardly from the skateboard trailing edge 22 to constitute a rear overhang section 33 of the board. The forward spacer block 30 can be positioned in close proximity to the leading edge 20 of the board. On the underside of each spacer block 32 is mounted a conventional truck 34 for supporting the wheels. Each spacer block and truck is secured or coupled to the platform by four bolts 42 which extend through aligned holes in the platform, the spacer block, and the truck. The bolts are maintained in place by conventional washers and nuts.

Each truck 34 comprises a horizontal axle 46 which lays in a plane transverse and typically perpendicular to the longitudinal center line 48 of the platform 12. Each axle supports a pair of axially aligned wheels 50 which are on opposite sides of the center line 48. Thus there are two pair or sets of wheels, secured to or positioned beneath the platform, where the wheels are aligned in tandem.

Although the skateboard of FIG. 1 is shown having four wheels, skateboards with fewer or more than four wheels are known.

With reference to FIG. 2, each wheel defines a circular cylindrical tread surface 52 and sidewalls 54 substantially perpendicular to the axis of rotation of the cylindrical tread surface 52. Each wheel is symmetrical about its axis of rotation, the axially inner edge 56 and the axially outer edge 58 of each wheel are radiused, thereby defining a convex tread surface. The cylindrical tread surface is of relatively wide width as compared to the two convex tread surfaces which are of relatively narrow width. The circular cylindrical tread surface constitutes the active tread when the skateboard is traveling in a straight line. When the skateboard is turning, a portion of the convex tread surface opposite the direction of the turn as well as the cylindrical tread surface constitute the active tread. Because the outer edges of the wheel cannot deform significantly, unlike with lipped wheels, the convex surface permits a rider of a skateboard to more readily negotiate all sorts of arcs, curves, and irregularities in surfaces in riding the skateboard.

An advantage of having a radius on both the axially inner edge and the axially outer edge of the circular tread surface is that each wheel of the skateboard provides a nondeforming tread surface for rolling over obstacles and gripping the surface being ridden, no matter which direction the rider is turning.

Additional benefits obtained by having a cylindrical tread section with radiused edges is that a rider can roll over larger obstacles such as cracks, bumps, twigs and toes at a faster speed without losing speed and without being thrown from the board than without radiused edges.

For maximum speed and traction, it is preferred that the front wheels be of the same size and shape and the back wheels be of the same shape and size. Wider and larger diameter wheels in the front than in the back can be desirable to compensate for riders putting more weight on the forward wheels.

The diameter of a wheel and the width of the cylindrical tread surface affect the speed at which the skateboard can travel and the amount of traction between the wheels and the surface being ridden. Generally, above a certain minimum value for the diameter, as the diameter of the wheels increases, the speed at which the skateboard travels increases and the amount of traction between the wheels and the ground decreases. Similarly, as the width of the cylindrical tread surface increases from zero, the speed of travel increases up to a certain width, after which it decreases as width increases. Traction or resistance to skidding increases up to a certain width, and then decreases with increasing width. Thus as the diameter of the wheels is increased, the width of the circular tread section is decreased to maintain an optimum balance between traction and speed for a constant loading.

Preferably the wheels have a diameter (shown by arrow 59 in FIG. 2) of from about 1¾ to about 2¾ inches, and most preferably about 2½ inches, and preferably the total tread section, including the cylindrical tread section and both convex tread sections, has a width (shown by arrow 60 in FIG. 2) of from about 1½ to about 2¾ inches to obtain a fast moving skateboard with more than adequate traction between the wheels and the ground for effecting elaborate moves with the skateboard. As the weight of the rider increases, the width and/or diameter of the wheel can be increased to maintain optimum speed and traction.

The minimum radius of curvature of the convex tread sections, i.e. the radius of the edges of the cylindrical tread sections, is about ⅛ to about 3/16 inch because at lesser values the benefits obtainable from having a convex tread surface are not obtained. As the radius of curvature of the convex tread section increases, the width of the cylindrical tread section decreases. Accordingly, the maximum radius of curvature of the convex tread surface is about ½ inch because at greater values, a wider, more expensive wheel is required to have sufficiently wide cylindrical tread surface to obtain adequate speed with the skateboard.

Preferably the axially outer edge of the tread surface of each wheel has a greater radius of curvature than the axially inner edge of the tread surface of such wheel because the outer edge of the tread surface is usually first to encounter obstructions in the path of travel, and because it is farther from the truck axle pivot point, it affects stability and direction of travel more than the inside edge. Thus preferably the axially outer circumferential edge of each wheel has radius of about ¼ inch to about ½ inch, and most preferably about ⅜ inch, and the axially inner circumferential edge preferably has a radius of from about ⅛ inch to about ⅜ inch, and most preferably about ¼ inch.

The wheels are fabricated from a resilient material having a high coefficient of friction such as a thermosetting polyurethane having a shore-A hardness of from about 86 to about 90. Such a polyurethane can be obtained from E. I. du Pont Company under the tradename Adoprene.

To mount each wheel on its axle, a hole is provided through each wheel along its axis of rotation and a thrust spacer or bushing 64 mounted in the hole through which a threaded portion 65 of the axle protrudes. Two sets of ball bearing assemblies 68 are mounted around each thrust spacer 64. Each wheel is held on the axle by means of a nut 70. In each side wall of each wheel there is a hollowed out portion 72 having a frusto-concial shape to minimize the amount of material required for forming the wheel and so the axle, bolt, and ball bearings are recessed.

Although this invention has been described in considerable detail with reference to certain versions thereof, other versions are within the scope of this invention. For example, wheels as described herein can be used with roller skates. Also, although the wheels have been shown in FIG. 2 as having a convex tread surface which has the shape of an arc of a sphere in cross-section, the tread surface can be somewhat elliptical in cross-section. Therefore the spirit and scope of the appended claims should not necessarily be limited to the description of the preferred versions contained herein.

What is claimed is:

1. A skateboard comprising an elongated platform having a longitudinal centerline and at lease one pair of wheels secured to and positioned beneath the platform, the wheels being axially spaced apart from each other on opposite sides of the center line along a common axis transverse to the longitudinal centerline of the platform, each wheel defining a circular cylindrical tread surface having an axially inner edge and an axially outer edge, the axially inner edge being closer to the centerline than the axially outer edge, wherein both the axially inner edge and the axially outer edge of the cylindrical tread surface of each such wheel defines a convex surface having a radius of curvature of from about $\frac{1}{8}$ to about $\frac{1}{2}$ inch, wherein, the radius of the axially outer edge of the tread surface of such wheels is greater than the radius of the axially inner edge of the tread surface of such wheels.

2. A skateboard comprising an elongated platform having a longitudinal centerline and at least one pair of wheels secured to and positioned beneath the platform, the wheels being axially spaced apart from each other on opposite sides of the centerline along a common axis transverse to the longitudinal centerline of the platform, each wheel defining a circular cylindrical tread surface having an axially inner edge and an axially outer edge, the axially inner edge being closer to the centerline than the axially outer edge, wherein the axially outer edge of the cylindrical tread surface of such wheels defines a convex surface having a radius of curvature of from about $\frac{1}{4}$ to about $\frac{1}{2}$ inch and the axially inner edge of the cylindrical tread surface of such wheels has a radius of from about $\frac{1}{8}$ inch to about $\frac{3}{8}$ inch.

3. The skateboard of claim 2 in which the diameter of each wheel is the same and is from about $1\frac{3}{4}$ to about $2\frac{3}{4}$ inches.

4. The skateboard of claim 2 in which the width of the tread surface of such wheels is from about $1\frac{1}{2}$ to about $2\frac{3}{4}$ inches.

5. The skateboard of claim 2 in which the axially outer edge of the tread surface of such wheels has a radius of about $\frac{3}{8}$ inch.

6. The skateboard of claim 2 in which the axially inner edge of the tread surface of such wheels has a radius of about $\frac{1}{4}$ inch.

7. The skateboard of claim 2 in which the diameter of each wheel is the same and is from about $1\frac{3}{4}$ to about $2\frac{3}{4}$ inches.

8. The skateboard of claim 2 in which the width of the tread surface of such wheels is from about $1\frac{1}{2}$ to about $2\frac{3}{4}$ inches.

9. A wheel mounted to rotate on an axle of a skateboard, the wheel being symmetrical about said axle and defining a circular cylindrical tread surface, the edges of said tread surface defining a convex surface having a radius of curvature of from about $\frac{1}{8}$ to about $\frac{1}{2}$ inch, wherein a first edge of said tread surface has a larger radius than a second edge of said tread surface.

10. A wheel as claimed in claim 9 having a diameter of from about $1\frac{3}{4}$ to about $2\frac{3}{4}$ inches and wherein the width of the tread surface is from about $1\frac{1}{2}$ to about $2\frac{3}{4}$ inches.

11. A skateboard wheel for mounting on an axle of a skateboard, the wheel having three tread portions of which one defines a cylindrical tread surface of relatively wide width, and each of the other two tread positions defined a convex tread surface of relatively narrow width, one of the convex surfaces being the closest surface to an extremity of the axle and merging into the cylindrical tread surface and having a radius of curvature of from about $\frac{1}{4}$ to about $\frac{1}{2}$ inch, and the cylindrical tread surface merging into the outer convex tread surface which has a radius of curvature of from about $\frac{1}{8}$ inch to about $\frac{3}{8}$ inch.

12. The wheel of claim 11 in which the radius of curvature of the convex tread surface closest to an extremity of the axle is greater than the radius of curvature of the other convex tread surface.

13. The wheel of claim 11 in which the width of the tread surface including all three tread portions is from about $1\frac{1}{2}$ to about $2\frac{3}{4}$ inches.

14. A wheel as claimed in claim 11 in which the diameter of the wheel is from about $1\frac{3}{4}$ to about $2\frac{3}{4}$ inches.

15. The skateboard of claim 11 in which the radius of curvature of the convex surface closest to an extremity of the axle is greater than the radius of curvature of the other convex tread surface.

16. A skateboard comprising:

an elongated platform having a forward end section, a rearward end section, and a longitudinal centerline, a first pair of wheels axially secured to and positioned beneath the platform forward end section, the first pair of wheels being axially aligned on an axis perpendicular to the longitudinal centerline of the platform, the wheels of the first pair of wheels being on opposite sides of the longitudinal centerline, a second pair of wheels secured to and positioned beneath the platform rearward end section aligned in tandem with the first pair of wheels, each wheel having an axially outer circumferential edge and an axially inner circumferential edge, with the axially outer edge being farther from the centerline than the axially inner edge, wherein each wheel has the same diameter of from about $1\frac{3}{4}$ to about $2\frac{3}{4}$ inches and each wheel defines a circular cylindrical tread section, the axially outer circumferential edge of each wheel defining a convex surface having a radius of curvature of from about 3/16 inch to about $\frac{1}{2}$ inch, and the axially inner circumferential edge of each wheel defining a convex surface having a radius of curvature of from about $\frac{1}{8}$ inch to about $\frac{1}{2}$ inch, the radius of the inner edges being less than the radius of the outer edges, and the width of the tread surface being from about $1\frac{1}{2}$ to about $2\frac{3}{4}$ inches, the radius of curvature of the outer circumferential edge of each wheel being the same and the radius of curvature of the inner circumferential edge of each wheel being the same.

* * * * *

UNITED STATES PATENT AND TRADEMARK OFFICE

CERTIFICATE OF CORRECTION

PATENT NO. : 4,128,254

DATED : December 5, 1978

INVENTOR(S) : George A. Powell

It is certified that error appears in the above-identified patent and that said Letters Patent are hereby corrected as shown below:

Column 1, line 21, change "thread" to - tread --;

Column 1, line 53 change "ar" to -- are --;

Column 4, line 45, change "frusto-concial" to -- frusto-conical

Column 4, line 65, change "center line " to -- centerline --;

Column 5, line 37, change "2" to --1 --;

Column 5, line 40, change "2" to --1 --;

Column 6, line 1, change "positions defined" to -- portions defines --;

Column 6, line 6 change " outer" to -- other --;

Signed and Sealed this

*Third* Day of *April 1979*

[SEAL]

*Attest:*

RUTH C. MASON
*Attesting Officer*

DONALD W. BANNER
*Commissioner of Patents and Trademarks*